US012065802B2

(12) United States Patent
Kollmann

(10) Patent No.: US 12,065,802 B2
(45) Date of Patent: Aug. 20, 2024

(54) QUICK-CHANGE DEVICE

(71) Applicant: OilQuick Deutschland KG, Steindorf (DE)

(72) Inventor: Michael Kollmann, Egling an der Paar (DE)

(73) Assignee: OilQuick Deutschland KG, Steindorf (DE)

( * ) Notice: Subject to any disclaimer, the term of this patent is extended or adjusted under 35 U.S.C. 154(b) by 774 days.

(21) Appl. No.: 17/186,202

(22) Filed: Feb. 26, 2021

(65) Prior Publication Data

US 2021/0270005 A1 Sep. 2, 2021

(30) Foreign Application Priority Data

Mar. 2, 2020 (DE) ..... 10 2020 105 460.2

(51) Int. Cl.
*E02F 3/36* (2006.01)

(52) U.S. Cl.
CPC ..... *E02F 3/3622* (2013.01); *E02F 3/3618* (2013.01); *E02F 3/365* (2013.01); *E02F 3/3663* (2013.01)

(58) Field of Classification Search
CPC ..... E02F 3/3636; E02F 3/3622; E02F 3/3618; E02F 3/365; E02F 3/3663; E02F 3/3604; E02F 3/3627; E02F 3/3609
See application file for complete search history.

(56) References Cited

U.S. PATENT DOCUMENTS 4,207,693 A 6/1980 Hemphill
5,927,665 A * 7/1999 Grabnic ..... E02F 3/3604 403/4
5,951,192 A * 9/1999 Collins ..... E02F 3/3636 403/150
5,971,455 A * 10/1999 Wolin ..... B66C 3/16 414/739

(Continued)

FOREIGN PATENT DOCUMENTS

CA 2234893 A1 * 10/1999 ..... E02F 3/3613
DE 10 2017 110 586 A1 11/2018

(Continued)

OTHER PUBLICATIONS

Result of examination report for German Patent Application No. 10 2020 105 460.2, filed Mar. 2, 2020.

*Primary Examiner* — Adam J Behrens
*Assistant Examiner* — Blake E Scoville
(74) *Attorney, Agent, or Firm* — Paul D. Bianco; Thomas S. Grzesik; Fleit Intellectual Property Law

(57) ABSTRACT

A quick-change device for changing attachments on a construction machine comprises a main body and parallel lateral flanks with oppositely disposed first and second bearing bushings for receiving mounting pins. To expand the range of applications, at least two oppositely disposed first bearing bushings can be inserted at different angular positions into first oppositely disposed passage openings in the lateral flanks by rotating the bearing bushings about an axis, which is offset relative to a central axis of a receiving hole of the first bearing bushing, and have an external contour for rotationally rigid engagement in a complementary internal contour of the passage opening.

9 Claims, 2 Drawing Sheets

(56) References Cited

U.S. PATENT DOCUMENTS

| | | | | | |
|---|---|---|---|---|---|
| 6,158,917 | A * | 12/2000 | Wolin | E02F 3/3636 | 37/456 |
| 6,364,561 | B1 * | 4/2002 | Droegemueller | E02F 3/967 | 403/336 |
| 6,662,681 | B2 * | 12/2003 | Crane | E02F 3/966 | 37/444 |
| 7,204,656 | B2 * | 4/2007 | Bjuhr | E02F 3/3636 | 403/4 |
| 9,534,624 | B2 * | 1/2017 | Rautionmaa | E02F 3/3613 | |
| 2012/0227246 | A1 * | 9/2012 | Dawson | E02F 3/3636 | 403/294 |

FOREIGN PATENT DOCUMENTS

| | | | | | |
|---|---|---|---|---|---|
| JP | 11269909 | A * | 10/1999 | E02F 3/3636 | |
| WO | 1999/006317 | A1 | 2/1999 | | |
| WO | 2001/083894 | A1 | 11/2001 | | |
| WO | 2003/069077 | A1 | 8/2003 | | |
| WO | WO-03069077 | A1 * | 8/2003 | E02F 3/3613 | |
| WO | WO-2014044914 | A1 * | 3/2014 | E02F 3/3613 | |

* cited by examiner

QUICK-CHANGE DEVICE

FIELD OF THE DISCLOSURE

The disclosure relates to a quick-change device for changing different attachments on construction machines.

BACKGROUND

Quick-change devices of this type are used for the easy and convenient changing of different attachments on construction machines. Using this type of quick-change device allows, e.g., swivel buckets, claws, shears, compactors, magnets, hydraulic hammers or other attachments to be coupled to and uncoupled from, e.g., a boom of an excavator, within a few seconds and with a high level of safety from an operator's cab.

DE 10 2017 110 586 A1 discloses a generic quick-change device. This quick-change device comprises a support having a main body and parallel lateral flanks, which support can be mounted on the boom arm of an excavator. On one side of the main body, first receptacles for a first coupling element, which is disposed on an attachment or an adapter, and, on the other side, second receptacles with a locking element for releasably holding a second coupling element, are arranged, wherein the locking element is able to move between a release position and a locking position. To be able to mount the support on the excavator, oppositely disposed rearward and forward bearing bushings for receiving mounting pins are disposed on the lateral flanks of the support. However, these bearing bushings are rigidly and unmovably disposed on the lateral flanks so that the position of the mounting pins is fixed and cannot be easily changed. As a result, the quick-change device can only be mounted on boom arms specially intended for this purpose.

Thus, there exists a need for a quick-change device of the type mentioned above which has a wider range of application and which can be universally used.

SUMMARY

Accordingly, a quick-change device is disclosed herein. Expedient embodiments and advantageous refinements are also disclosed.

One aspect of the disclosure relates to a quick-change device comprising at least two oppositely disposed first bearing bushings which can be inserted at different angular positions into first oppositely disposed passage openings in the lateral flanks by rotating them about an axis which is offset relative to a central axis of a receiving hole of the bearing bushing and which have an external contour for rotationally rigid engagement in a complementary internal contour of the passage openings. This allows the position of the receiving hole of the bearing bushing relative to the lateral flank to be readily changed and adjusted to the particular respective requirements. Because of the external contour on the bearing bushing and the complementary internal contour of the passage opening in the lateral flanks, an interlocking, reciprocally engaging connection between the bearing bushing and the lateral flank is formed, thus making possible a connection which is especially stable and which securely prevents an undesirable displacement.

In an especially advantageous embodiment, the external contour on the first bearing bushings and the internal contour of the first passage openings are configured to have a polygonal profile. However, the interlocking connection between the first bearing bushings and the lateral flanks can also be achieved, e.g., by means of external and internal spline teeth, by means of a splined shaft and splined hub profile or by means of an external and internal polygonal profile.

The external contour can be favorably disposed on an engagement portion of the bearing bushing, which engagement portion engages in the first passage opening. For mounting on the lateral flank, the first bearing bushing can comprise a mounting flange having tapped bores.

Additional means of adjustment can be achieved by disposing the oppositely disposed second bearing bushings in second passage openings, which are configured as slotted holes, in the lateral flanks and by securing them against displacement by means of an interlocking connection.

The interlocking connection can be formed, e.g., by arch-shaped recesses on the upper and lower surfaces of the second passage opening and complementary arch-shaped elevations on the second bearing bushing. The arch-shaped elevations can be disposed on an engagement region of the second bearing bushing, which engagement region engages in the second passage opening.

The second bearing bushings can be mounted on the lateral flanks by means of a retaining plate. The retaining plate can be disposed, e.g., on the outside surface of the lateral flank and be fastened to the second bearing bushing by means of screws.

BRIEF DESCRIPTION OF THE DRAWINGS

Additional characteristic features and advantages of the disclosure follow from the description of a preferred embodiment example below with reference to the drawings. The drawings show.

DETAILED DESCRIPTION

Figure 1:
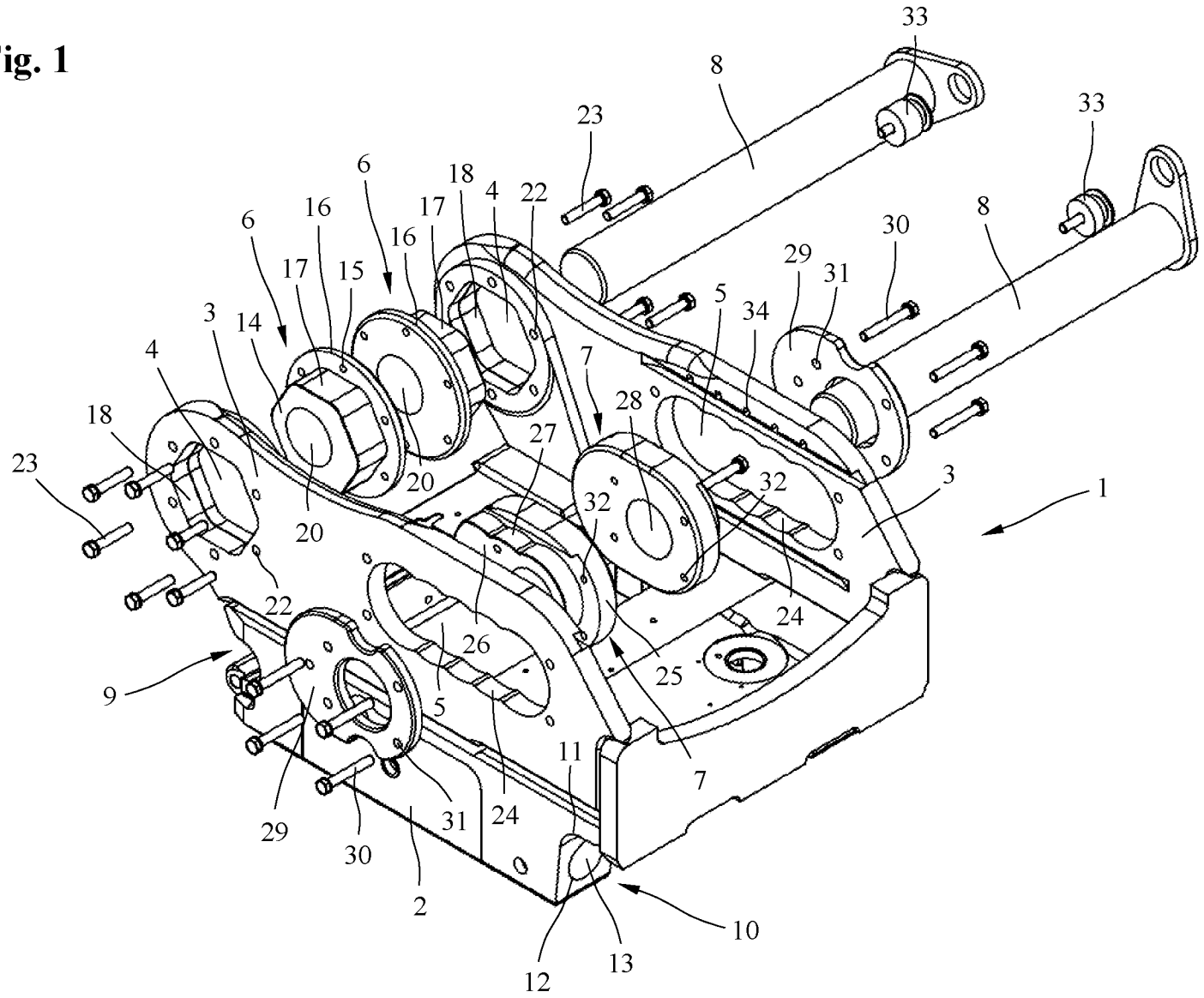
FIG. 1 an exploded view of a quick-change device according to the disclosure and FIG. 2 a longitudinal section through the quick-change device shown in FIG. 1 in the plane of a lateral flank.

FIG. 1 shows a quick-change device 1 for easily and conveniently changing different attachments on construction machines, especially excavators. Using this type of quick-change device 1 allows, e.g., swivel buckets, claws, shears, magnets, compactors, hydraulic hammers or other mechanical and/or hydraulic attachments to be easily and conveniently coupled to and uncoupled from a boom or another attachment part of an excavator or a different construction vehicle from an operator's cab.

The quick-change device 1 comprises a support in the form of a welded or cast part, which support comprises a main component 2 and two parallel lateral flanks 3 with passage openings 4 and 5 for receiving bearing bushings 6 and 7 for parallel connecting pins 8. By means of the connecting pins 8, the quick-change device 1 can be mounted, e.g., on the boom arm of an excavator or other work equipment.

On one side, the main component 2, which in cross section has an inverted U-shaped profile, has rearwardly open first receptacles 9 for receiving and holding a first bolt-shaped coupling element and, on the other side, downwardly open second receptacles 10 for receiving and holding a second bolt-shaped coupling element. The bolt-shaped coupling elements can be disposed, e.g., on an attachment or an adapter which can be mounted on the attachment.

In the embodiment example shown, the back face of the body part 2 of the quick-change device 1 has two first spaced-apart receptacles 9 for the first coupling element and the front face has two spaced-apart receptacles 10 for the second coupling element. The rearwardly open first receptacles 9 have the shape of a fork or claw. The downwardly open second receptacles 10 have a curved lower abutment face 11 for abutting the second bolt-shaped coupling element. On the two receptacles 10 on the front face of the body part 2, a locking mechanism is disposed, each having a bolt-shaped locking element 13 which is movably guided in a guide bore 12 inside the body part 2 and which can be moved by means of a drive between a retracted release position and an extended locking position. In the extended locking position, the downwardly open second receptacles 10 are closed on the bottom face by the bolt-shaped locking elements 13, which are movably disposed in the guide bores 12 inside the body part 2 so that the second bolt-shaped coupling element is engaged from below and held by the bolt-shaped locking elements 13. Instead of the bolt-shaped locking elements 13, it is also possible for locking elements in the form of hooks or other shapes to be disposed on the body part 2 of the support.

To couple an attachment by means of the quick-change device 1, the quick-change device 1, which, as a rule, is disposed on the boom of an excavator, is first moved such that the first coupling element, which is disposed on an adapter or directly on the attachment, is retracted into the claw- or fork-shaped receptacles 9 on one side of the quick-change device 1. Next, the quick-change device 1, with the locking elements 13 still retracted, is pivoted about the first bolt-shaped coupling element such that the second coupling element on the adapter or attachment comes to abut the abutment faces 11 of the downwardly open receptacles 10 on the other side of the quick-change device 1. The locking elements 13, which are movably disposed in the guide bores 12 inside the body part 2 of the support, can then be hydraulically extended such that the second bolt-shaped coupling element is engaged from below by the two bolt-shaped locking elements 13 on the quick-change device 1 and the attachment is thus held on the quick-change device 1.

Figure 2:
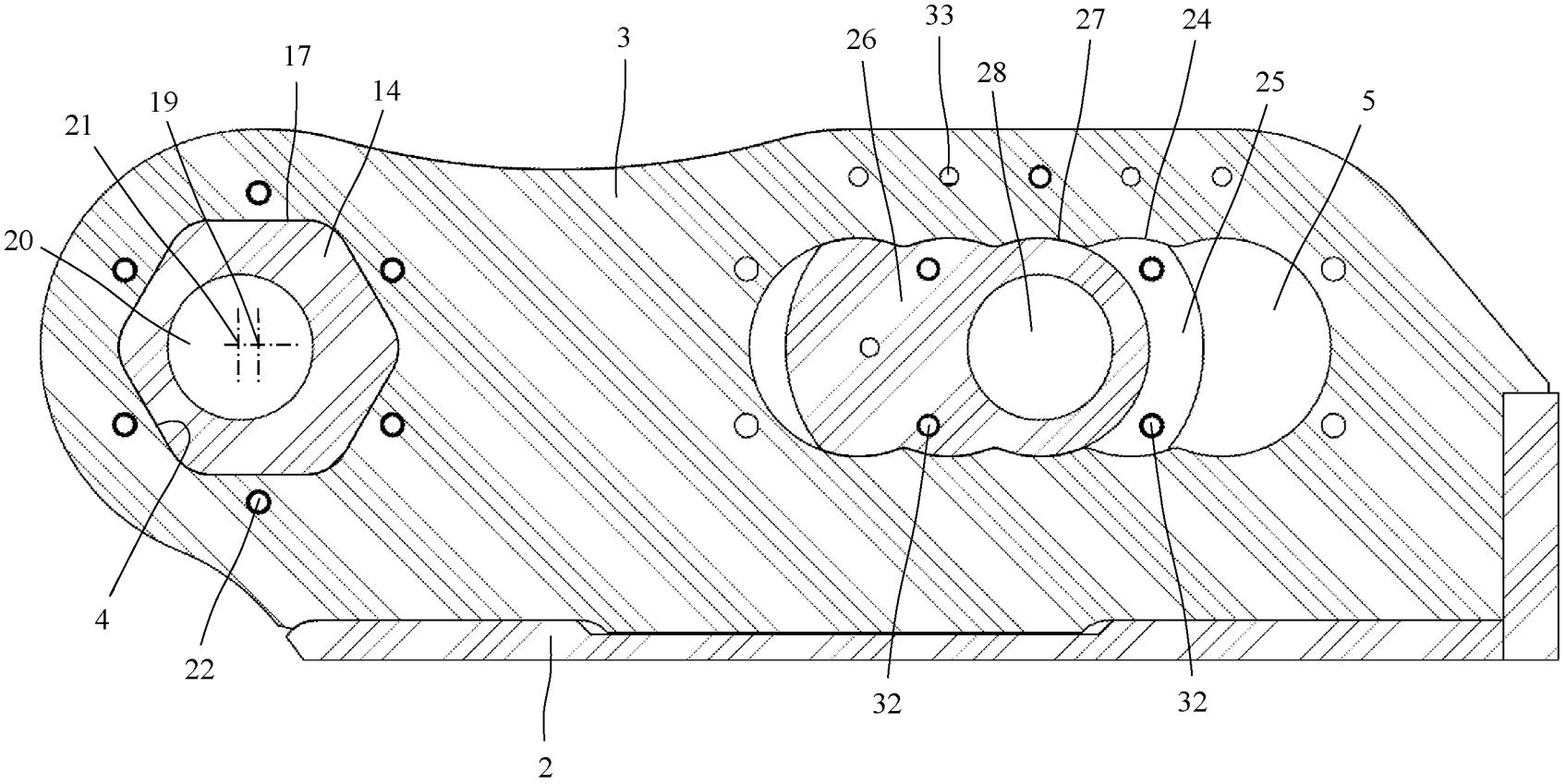

As FIGS. 1 and 2 indicate, two oppositely disposed rearward passage openings 4 for receiving first bearing bushings 6 and two oppositely disposed forward passage openings 5 for receiving second bearing bushings 7 are provided in the two lateral flanks 3 of the support. The rearward first bearing bushings 6 have an engagement portion 14 for engaging in the rearward passage opening 4 and a mounting flange 16 having tapped bores 15. The engagement portion 14 of the rearward bearing bushing 6 has an external contour 17, here configured as an external hexagonal profile, for interlocking engagement in a complementary internal contour 18, here configured as an internal hexagonal profile, of the rearward passage opening 5. This allows the first bearing bushing 6 inside the passage opening 4 to be rotated at different angular positions about an axis 19 shown in FIG. 1 and to be inserted at a specific position into the passage opening 5 and secured against rotation.

Disposed in the first bearing bushing 6 is a receiving bore 20 which is eccentric relative to the axis 19. The central axis 21 of the receiving bore 20 is offset relative to the axis 19 such that the position of the receiving bore 20 relative to the lateral flank 3 can be changed by rotating the first bearing bushing 6. Arranged around the passage opening 5 in the lateral flanks 3 are a plurality of through-bores 22 for screws 23, which through-bores are in alignment with the tapped bores 15 in the mounting flange 16. The bearing bushing 6 inserted at a specific angular position into the passage opening 4 of the lateral flank 3 can be mounted on the lateral flank 3 by means of the screws 23.

The external contour 17 and the complementary internal contour 18 are favorably configured to have a polygonal profile. However, the connection between the bearing bushing 6 and the lateral flank 3 can also be achieved, e.g., by means of external and internal spline teeth, by means of a splined shaft and splined hub profile, or by means of an external and internal polygonal profile.

The forwardly disposed second passage openings 5 in the lateral flanks 3 are configured as slotted holes with arch-shaped recesses 24 on the upper and lower surfaces. The forwardly disposed second bearing bushings 7 have an oval main body with a flange 25 and an engagement region 26 for interlocking engagement in the forward passage opening 5.

As FIG. 2 indicates, the engagement region 26, on its upper and lower surfaces, has arch-shaped elevations 27 complementary to the recesses 24. Also disposed in the forward bearing bushing 7 is a receiving bore 28 for receiving a mounting pin 8. Because of the design of the forward passage opening 5 and the engagement region 26, the bearing bushing 7, inside the passage opening 5 which is configured as a slotted hole, can be inserted at different positions on the lateral flank 3 and is there secured against displacement. Thus, the position of the receiving bore 28 relative to the lateral flank 3 can be easily changed.

The forward bearing bushing 7 is mounted to the lateral flank 3 by means of a retaining plate 29 shown in FIG. 1, which retaining plate is disposed on the outside face of the lateral flank 3 and screwed to the bearing bushing 7 by means of screws 30. To this end, the retaining plate 29 has through-bores 31, and the bearing bushing 7 has complementary tapped bores 32. By means of mounting elements 33 and tapped bores 34 in the lateral flanks 3, the mounting pins 8 can be locked into position on the lateral flanks 3.

LIST OF REFERENCE CHARACTERS

1 Quick-change device
2 Main body
3 Lateral flank
4 First passage opening
5 Second passage opening
6 First bearing bushing
7 Second bearing bushing
8 Mounting pins
9 First receptacle
10 Second receptacle
11 Abutment face
12 Guide bore
13 Locking element
14 Engagement portion
15 Tapped bores
16 Mounting flange
17 External contour
18 Internal contour
19 Axis
20 Receiving bore
21 Central axis
22 Through-bore
23 Screw
24 Recess
Flange
26 Engagement region
27 Elevation
28 Receiving bore
29 Retaining plate

30 Screw
31 Through-bore
32 Tapped bore
33 Mounting element
34 Tapped bore

The invention claimed is:

1. A quick-change device for changing attachments on a construction machine, the quick-change device comprising:

a main body; and parallel lateral flanks with oppositely disposed first bearing bushings and oppositely disposed second bearing bushings each for receiving mounting pins, wherein at least two first bearing bushings of the oppositely disposed first bearing bushings are each insertable at different angular positions into first oppositely disposed passage openings in the parallel lateral flanks by rotating the first bearing bushing about an axis that is offset relative to a central axis of a receiving bore of the first bearing bushing, wherein the at least two first bearing bushings have an external contour for rotationally rigid engagement in a complementary internal contour of the first oppositely disposed passage openings, wherein each of the oppositely disposed second bearing bushings is disposed in a respective one of second passage openings of the parallel lateral flanks and is secured against displacement by an interlocking connection, wherein the second passage openings are configured as slotted holes, wherein the interlocking connection is formed by arch-shaped recesses on upper and lower surfaces of the respective one of the second passage openings and complementary arch-shaped elevations on the oppositely disposed second bearing bushing, and wherein the external contour on each of the at least two first bearing bushings and the complementary internal contour on the first oppositely disposed first passage openings are configured to have a polygonal profile.

2. The quick-change device of claim 1, wherein the external contour on each of the at least two first bearing bushings is disposed on an engagement portion of the first bearing bushing, which engagement portion engages in the respective one of the first oppositely disposed passage openings.

3. The quick-change device of claim 1, wherein each of the at least two first bearing bushings comprises a mounting flange having tapped bores for mounting each of the at least two first bearing bushings on the respective one of the parallel lateral flanks.

4. The quick-change device of claim 1, wherein the complementary arch-shaped elevations are disposed on an engagement region of the oppositely disposed second bearing bushing, which engagement region engages in the respective one of the second passage openings.

5. The quick-change device of claim 1, wherein each of the oppositely disposed second bearing bushings is mounted on a respective one of the parallel lateral flanks by a retaining plate.

6. The quick-change device of claim 5, wherein the retaining plate is disposed on an outside surface of the respective one of the parallel lateral flanks and is screwed to each of the oppositely disposed second bearing bushings by screws.

7. The quick-change device of claim 1, wherein the mounting pins are locked into position on the respective one of the parallel lateral flanks by mounting elements.

8. A quick-change device for changing attachments on a construction machine, the quick-change device comprising:

a main body; and parallel lateral flanks with oppositely disposed first bearing bushings and oppositely disposed second bearing bushings each for receiving mounting pins, wherein at least two first bearing bushings of the oppositely disposed first bearing bushings are each insertable at different angular positions into first oppositely disposed passage openings in the parallel lateral flanks by rotating the first bearing bushing about an axis that is offset relative to a central axis of a receiving bore of the first bearing bushing, wherein each of the oppositely disposed second bearing bushings is disposed in a respective one of second passage openings of the parallel lateral flanks and is secured against displacement by an interlocking connection, wherein each of the second passage openings is configured as a slotted hole having a plurality of locations at which the oppositely disposed second bearing bushing is securable, wherein the interlocking connection is formed by arch-shaped recesses on upper and lower surfaces of the respective one of the second passage openings and complementary arch-shaped elevations on the oppositely disposed second bearing bushing.

9. The quick change device of claim 8, wherein the at least two first bearing bushings have an external contour for rotationally rigid engagement in a complementary internal contour of the first oppositely disposed passage openings.

* * * * *